US011359267B2

(12) United States Patent
Miyamoto et al.

(10) Patent No.: US 11,359,267 B2
(45) Date of Patent: Jun. 14, 2022

(54) HIGH-CARBON HOT-ROLLED STEEL SHEET AND METHOD FOR MANUFACTURING THE SAME

(71) Applicant: JFE Steel Corporation, Tokyo (JP)

(72) Inventors: Yuka Miyamoto, Tokyo (JP); Yasuhiro Sakurai, Tokyo (JP); Takashi Kobayashi, Tokyo (JP); Shunsuke Toyoda, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 212 days.

(21) Appl. No.: 16/486,908

(22) PCT Filed: Feb. 13, 2018

(86) PCT No.: PCT/JP2018/004864
§ 371 (c)(1),
(2) Date: Aug. 19, 2019

(87) PCT Pub. No.: WO2018/155254
PCT Pub. Date: Aug. 30, 2018

(65) Prior Publication Data

US 2020/0232074 A1 Jul. 23, 2020

(30) Foreign Application Priority Data

Feb. 21, 2017 (JP) ..... JP2017-029632

(51) Int. Cl.

| | |
|---|---|
| ***C22C 38/18*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C22C 38/18* (2013.01); *C21D 8/0205* (2013.01); *C21D 8/0226* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/04* (2013.01); *C21D 2211/005* (2013.01)

(58) Field of Classification Search
CPC ..... C22C 38/18; C22C 38/001; C22C 38/002; C22C 38/02; C22C 38/04; C21D 8/0205; C21D 8/0226; C21D 8/0236; C21D 9/46; C21D 2211/005
See application file for complete search history.

(56) References Cited

U.S. PATENT DOCUMENTS

| | | | | |
|---|---|---|---|---|
| 2009/0308504 | A1* | 12/2009 | Kariya | C22C 38/04 148/333 |
| 2014/0069556 | A1 | 3/2014 | Kobayashi et al. | |
| 2018/0230582 | A1* | 8/2018 | Takeda | C22C 38/42 |

FOREIGN PATENT DOCUMENTS

| | | | | |
|---|---|---|---|---|
| CN | 104364407 | A | | 2/2015 |
| CN | 105378132 | A | | 3/2016 |
| CN | 106133170 | A | | 11/2016 |
| EP | 2857542 | A1 | | 4/2015 |
| EP | 3020843 | A1 | | 5/2016 |
| EP | 3091098 | A1 | | 11/2016 |
| JP | 5585626 | A | | 6/1980 |
| JP | 11140544 | A | | 5/1999 |
| JP | 2001073033 | A | | 3/2001 |
| JP | 2001081528 | A | | 3/2001 |
| JP | 2008088448 | A | | 4/2008 |
| JP | 2010255066 | A | * | 11/2010 |
| JP | 2010255066 | A | | 11/2010 |
| JP | 2015117406 | A | | 6/2015 |
| WO | 2012157267 | A1 | | 11/2012 |
| WO | 2016190370 | A1 | | 12/2016 |

OTHER PUBLICATIONS

Edited by Li, H., "Common Knowledge in Metallography and Heat Treatment of Steel," Published by Metallurgical Industry Press, Nov. 30, 1975, 10 pages (with translation).
Chinese Office Action with Search Report for Chinese Application No. 201880012964.4, dated Jun. 8, 2021, 11 pages.
Korean Grant of Patent for Korean Application No. 10-2019-7024056, dated May 10, 2021 with translation, 4 pages.
Liu, Y., "Isothermal Heat Treatment of Steel," China Machine Press, Jan. 31, 1964, 1966.3, 1st edition; 1973.4, 2nd print, 8 pages (with translation).
Zhou, Q, et al., "Engineering Materials and Mechanism Foundation," Mar. 31, 2015, 2015.3, 1st edition; 1st print, Northwestern Polytechnical University Press Co., Ltd., 7 pages (with translation).
Chinese Office Action with Search Report for Chinese Application No. 201880012964.4, dated Nov. 18, 2020, 11 pages.
Korean Office Action for Korean Application No. 10-2019-7024056, dated Nov. 3, 2020, 7 pages.
International Search Report and Written Opinion for International Application No. PCT/JP2018/004864 dated May 1, 2018, 4 pages.
Chinese Office Action for Chinese Application No. 201880012964.4, dated Sep. 16, 2021, with Concise Statement of Relevance of Office Action, 7 pages.

* cited by examiner

*Primary Examiner* — Christopher S Kessler
*Assistant Examiner* — Andrew M Cheung
(74) *Attorney, Agent, or Firm* — RatnerPrestia

(57) ABSTRACT

Provided are a high-carbon hot-rolled steel sheet with excellent formability and hardenability and a method for manufacturing the same.

The high-carbon hot-rolled steel sheet has a composition containing, on a mass basis, C: 0.10% to 0.33%, Si: 0.15% to 0.35%, Mn: 0.5% to 0.9%, P: 0.03% or less, S: 0.010% or less, sol. Al: 0.10% or less, N: 0.0065% or less, and Cr: 0.90% to 1.5%, the remainder being Fe and inevitable impurities, has a microstructure containing ferrite and cementite, a cementite density being 0.25 grains/$\mu m^2$ or less, and has a hardness of 110 HV to 160 HV and a total elongation of 40% or more.

16 Claims, No Drawings

HIGH-CARBON HOT-ROLLED STEEL SHEET AND METHOD FOR MANUFACTURING THE SAME

CROSS REFERENCE TO RELATED APPLICATIONS

This is the U.S. National Phase application of PCT/JP2018/004864, filed Feb. 13, 2018, which claims priority to Japanese Patent Application No. 2017-029632, filed Feb. 21, 2017, the disclosures of these applications being incorporated herein by reference in their entireties for all purposes.

FIELD OF THE INVENTION

The present invention relates to a high-carbon hot-rolled steel sheet with excellent formability and hardenability and a method for manufacturing the same.

BACKGROUND OF THE INVENTION

At present, automotive parts such as transmissions and seat recliners are mostly manufactured in such a manner that hot-rolled steel sheets which belong to carbon steels for machine structural use and alloy steels for machine structural use specified in JIS G 4051 are cold-formed into desired shapes, and then quenched for the purpose of ensuring a desired hardness. Therefore, hot-rolled steel sheets used as materials for automotive parts need to have excellent cold formability and hardenability; and various kinds of steel sheets for such materials have been proposed.

For example, Patent Literature 1 proposes a high-carbon hot-rolled steel sheet with excellent punchability. The high-carbon hot-rolled steel sheet contains, on a mass basis, C: 0.1% to 0.7%, Si: 0.01% to 1.0%, Mn: 0.1% to 3.0%, P: 0.001% to 0.025%, S: 0.0001% to 0.01%, T. Al: 0.001% to 0.10%, and N: 0.001% to 0.010%; further contains one or more of Ti: 0.01% to 0.20%, Cr: 0.01% to 1.50%, Mo: 0.01% to 0.50%, B: 0.0001% to 0.010%, Nb: 0.001% to 0.10%, V: 0.001% to 0.2%, Cu: 0.001% to 0.4%, W: 0.001% to 0.5%, Ta: 0.001% to 0.5%, Ni: 0.001% to 0.5%, Mg: 0.001% to 0.03%, Ca: 0.001% to 0.03%, Y: 0.001% to 0.03%, Zr: 0.001% to 0.03%, La: 0.001% to 0.03%, and Ce: 0.001% to 0.030%; and has a Vickers hardness of 100 HV to 160 HV. The invention described in Patent Literature 1 has an object to soften a medium/high-carbon hot-rolled steel sheet such that excellent punchability can be sufficiently exhibited while the hardenability is maintained.

Patent Literature 2 proposes a high-carbon steel strip in which both formability in cold forming, such as spinning and form rolling, and hardenability in quenching are achieved, and also proposes a method for manufacturing the same. The high-carbon steel strip contains, on a mass basis, C: 0.15% to 0.75%, Si: 0.3% or less, Mn: 0.2% to 1.60%, Sol. Al: less than 0.05%, and N: 0.0060% or less and further contains one or more of Cr: 0.2% to 1.2%, Mo: 0.05% to 1.0%, Ni: 0.05% to 1.2%, V: 0.05% to 0.50%, Ti: 0.005% to 0.05%, and B: 0.0005% to 0.0050%.

Patent Literature 3 proposes a method for manufacturing a medium/high-carbon steel sheet with excellent local ductility using steel containing, on a mass basis, C: 0.10% to 0.60%, Si: 0.4% or less, Mn: 1.0% or less, Cr: 1.6% or less, Mo: 0.3% or less, Cu: 0.3% or less, Ni: 2.0% or less, N: 0.01% or less, P: 0.03% or less, S: 0.01% or less, and T. Al: 0.1% or less, the remainder being Fe and inevitable impurities. It is an object in this literature to obtain a steel sheet capable of withstanding high forming such as stretch flange forming which requires local ductility, in addition to punching and bending, for integral forming of parts and simplification of steps for manufacturing parts for the purpose of reducing the manufacturing cost of parts.

PATENT LITERATURE

Patent Literature 1: Japanese Unexamined Patent Application Publication No. 2015-117406

Patent Literature 2: Japanese Unexamined Patent Application Publication No. 2001-81528

Patent Literature 3: Japanese Unexamined Patent Application Publication No. 2001-73033

SUMMARY OF THE INVENTION

In a technique described in Patent Literature 1, it is necessary that, upon hot rolling, a rough bar is heated to a temperature of 20° C. to 150° C. after the completion of rough rolling and finish rolling is completed in a temperature range from 600° C. to lower than Ae3−20° C. Finish rolling in a temperature range lower than the Ae3 temperature is effective in softening by coarsening ferrite grains. However, there is a problem in that a heterogeneous microstructure is formed to cause a reduction in elongation or it is difficult to stably perform actual operation. Furthermore, the size of ferrite grains is 10 μm to 50 μm, that is, relatively coarse ferrite grains are contained.

In a technique described in Patent Literature 2, softening is achieved by performing box annealing in a temperature range from Ac1−50° C. to Ac1+40° C. after hot rolling or by repeating cold rolling and annealing in a temperature range from 650° C. to Ac1 one or more times after the above annealing; hence, there is a problem in that the number of steps is large.

Patent Literature 3 describes a technique for obtaining a steel sheet with excellent local ductility by holding in a temperature range not lower than Ac1 after hot rolling and then cooling at 50° C./h or less. An annealed steel sheet is softened by adjusting the $\alpha/\gamma$ interface quantity per unit area of $\gamma$ at a temperature not lower than the Ac1 temperature or the number of carbides per 100 $\mu m^2$ at a temperature not lower than the Ac1 temperature, whereby the elongation and the hole expansion ratio are increased. However, hardenability is not described. It is conceivable that softening occurs by containing many coarse carbides, and there is a concern that carbides are not sufficiently dissolved in the austenite region during heating for quenching and hardenability cannot be ensured.

Aspects of the present invention solve the above problems and have an object to provide a high-carbon hot-rolled steel sheet with excellent cold formability and hardenability and to provide a method for manufacturing the same, the high-carbon hot-rolled steel sheet stably exhibiting excellent hardenability even if annealing is performed in a nitrogen atmosphere, and having a hardness of 110 HV to 160 HV and a total elongation El of 40% or more before quenching.

The inventors have intensively investigated the relationship between conditions for manufacturing a high-carbon hot-rolled steel sheet and cold formability, and the relationship between the conditions and hardenability, where the steel sheet contains Cr and preferably further contains one or more of Ni and Mo and one or more of Sb, Sn, Bi, Ge, Te, and Se. As a result, the inventors have obtained findings below.

i) A microstructure containing ferrite and cementite and the cementite density significantly affect the hardness and total elongation (hereinafter also simply referred to as elongation) of an unquenched high-carbon hot-rolled steel sheet, and by setting the cementite density to 0.25 grains/$\mu m^2$ or less, a hardness of 110 HV to 160 HV and a total elongation (El) of 40% or more can be obtained.

ii) In a general case of annealing a steel sheet in a nitrogen atmosphere, nitrogen of the nitrogen atmosphere enters the steel sheet to concentrate therein, and combines with Cr in the steel sheet to form Cr nitrides or combines with Mo in the steel sheet to form Mo nitrides, resulting in a slight reduction in the amounts of solute Cr and solute Mo in the steel sheet in some cases. However, for aspects of the present invention, entering of nitrogen as described above is prevented by allowing a steel to preferably contain a predetermined amount of at least one of Sb, Sn, Bi, Ge, Te, or Se; hence, the reduction in the amount of solute Cr and solute Mo is suppressed, and high hardenability can be ensured.

Aspects of the present invention have been made on the basis of these findings and are as summarized below.

[1] A high-carbon hot-rolled steel sheet has a composition containing, on a mass basis, C: 0.10% to 0.33%, Si: 0.15% to 0.35%, Mn: 0.5% to 0.9%, P: 0.03% or less, S: 0.010% or less, sol. Al: 0.10% or less, N: 0.0065% or less, and Cr: 0.90% to 1.5%, the remainder being Fe and inevitable impurities; has a microstructure containing ferrite and cementite, a cementite density of the cementite being 0.25 grains/$\mu m^2$ or less; and has a hardness of 110 HV to 160 HV and a total elongation of 40% or more.

[2] In the high-carbon hot-rolled steel sheet specified in Item [1], the composition further contains 0.5% or less of one or more of Ni and Mo in total on a mass basis.

[3] In the high-carbon hot-rolled steel sheet specified in Item [1] or [2], the composition further contains 0.002% to 0.03% of one or more of Sb, Sn, Bi, Ge, Te, and Se in total on a mass basis.

[4] In the high-carbon hot-rolled steel sheet specified in any one of Items [1] to [3], the average grain size of the ferrite is 5 μm to 15 μm.

[5] A method for manufacturing the high-carbon hot-rolled steel sheet specified in any one of Items [1] to [4] includes: rough hot rolling steel; finish-rolling the steel at a finishing temperature not lower than the Ar3 transformation temperature; coiling the steel at a coiling temperature of 500° C. to 700° C.; heating the steel to an annealing temperature not lower than the Ac1 transformation temperature and not higher than 800° C., and holding for 1 hr or more; cooling the steel to a temperature lower than the Ar1 transformation temperature at an average cooling rate of 1° C./hr to 20° C./hr; and holding the steel in a temperature range lower than the Art transformation temperature for 20 hr or more.

[6] A method for manufacturing the high-carbon hot-rolled steel sheet specified in any one of Items [1] to [4] includes rough hot rolling steel; finish-rolling the steel at a finishing temperature not lower than the Ar3 transformation temperature; coiling the steel at a coiling temperature of 500° C. to 700° C.; holding the steel in a temperature range from 680° C. to 720° C. for 1 hr to 35 hr; heating the steel to an annealing temperature not lower than the Ac1 transformation temperature and not higher than 800° C., and holding for 1 hr or more; and cooling the steel to a cooling stop temperature not higher than the Ar1 transformation temperature and not lower than (the Ar1 transformation temperature−110° C.) at an average cooling rate of 1° C./hr to 20° C./hr.

According to aspects of the present invention, a high-carbon hot-rolled steel sheet with excellent cold formability and hardenability is obtained.

Because the high-carbon hot-rolled steel sheet according to aspects of the present invention has excellent cold formability and hardenability, it is suitable for automotive parts such as gears, transmissions, and seat recliners where cold formability is required of blank steel sheets.

DETAILED DESCRIPTION OF EMBODIMENTS OF THE INVENTION

A high-carbon hot-rolled steel sheet according to aspects of the present invention and a method for manufacturing the same are described below in detail. The unit "%" of the content of each component refers to "mass percent" unless otherwise specified.

1) Composition

C: 0.10% to 0.33%

C is an element important in obtaining post-quenching strength. When the content of C is less than 0.10%, no desired hardness is obtained by heat treatment after parts are formed. Therefore, the C content needs to be 0.10% or more. However, when the C content is more than 0.33%, the hardness increases excessively and the toughness and the cold formability deteriorate. Thus, the C content is set to 0.10% to 0.33%. In order to obtain excellent quenching hardness, the C content is preferably set to 0.15% or more. Furthermore, in order to stably obtain a Vickers hardness (HV) of 430 or more after oil quenching, the C content is preferably set to 0.18% or more. In a case of use for the cold forming of parts difficult to form, the C content is preferably set to 0.28% or less.

Si: 0.15% to 0.35%

Si is an element which increases the strength by solid solution strengthening. As the content of Si increases, the hardness increases and the cold formability deteriorates. Therefore, the Si content is set to 0.35% or less. The Si content is preferably 0.33% or less. On the other hand, Si has an effect of increasing the temper softening resistance. When the Si content is less than 0.15%, it becomes difficult to obtain the effect of the temper softening resistance. Therefore, the Si content is set to 0.15% or more. The Si content is preferably 0.18% or more.

Mn: 0.5% to 0.9%

Mn is an element which enhances the hardenability and which increases the strength by solid solution strengthening. When the content of Mn is more than 0.9%, a banded structure due to the segregation of Mn develops to cause heterogeneous microstructure, and as a result, the cold formability decreases. Thus, the Mn content is set to 0.9% or less. However, when the Mn content is less than 0.5%, the hardenability tends to decrease. Therefore, the Mn content is set to 0.5% or more. The Mn content is preferably 0.55% or more and more preferably 0.60% or more.

P: 0.03% or less

P is an element which increases the strength by solid solution strengthening. However, increasing the content of P above 0.03% causes grain boundary embrittlement, and the post-quenching toughness deteriorates. Thus, the P content is set to 0.03% or less. In order to obtain excellent post-quenching toughness, the P content is preferably 0.02% or less. Since P reduces the cold formability and the post-quenching toughness, it is desirable that the P content be minimized. However, since excessive reduction in the P content increases refining costs, the P content is preferably 0.005% or more.

S: 0.010% or less

S is an element of which the content must be reduced because S forms sulfides to reduce the cold formability and post-quenching toughness of the high-carbon hot-rolled steel sheet. When the content of S is more than 0.010%, the cold formability and post-quenching toughness of the high-carbon hot-rolled steel sheet deteriorate significantly. Thus, the S content is set to 0.010% or less. In order to obtain excellent cold formability and post-quenching toughness, the S content is preferably 0.005% or less. Since S reduces the cold formability and the post-quenching toughness, it is desirable that the S content be minimized. However, since excessive reduction in the S content increases refining costs, the S content is preferably 0.0005% or more.

sol. Al: 0.10% or less

When the content of sol. Al is more than 0.10%, AlN is formed during heating for quenching and austenite grains are excessively refined. As a result, the formation of a ferrite phase is accelerated during cooling and the resultant microstructure will be composed of ferrite and martensite, resulting in a decrease in the post-quenching hardness. Thus, the sol. Al content is set to 0.10% or less and is preferably set to 0.06% or less. On the other hand, sol. Al has a deoxidation effect. In order to ensure sufficient deoxidation, the sol. Al content is preferably set to 0.005% or more.

N: 0.0065% or less

When the content of N is more than 0.0065%, austenite grains are excessively refined by the formation of AlN during heating for quenching, the formation of a ferrite phase is accelerated during cooling, and the post-quenching hardness decreases. Thus, the N content is set to 0.0065% or less. The lower limit of the N content is not particularly limited. As described above, however, N is an element which forms AlN, Cr nitrides, and Mo nitrides, thereby moderately suppressing the growth of austenite grains during heating for quenching and increasing the post-quenching toughness. Therefore, the N content is preferably 0.0005% or more.

Cr: 0.90% to 1.5%

Cr is an important element which enhances the hardenability. When the content of Cr is less than 0.90%, such effect is not sufficiently observed. Therefore, the Cr content needs to be 0.90% or more. However, when the Cr content is more than 1.5%, an unquenched steel sheet is hardened and the cold formability thereof is impaired. Therefore, the Cr content is set to 1.5% or less. In a case of forming parts that are difficult to press-form and require high formability, even more excellent formability is necessary. Therefore, in such a case, the Cr content is preferably 1.2% or less.

One or more of Ni and Mo: 0.5% or less in total

Both Ni and Mo are important elements which enhance the hardenability and are able to enhance the hardenability when the content of Cr alone is not sufficient for ensuring the hardenability. Ni and Mo also have an effect of suppressing the temper softening resistance. In order to obtain such an effect, a total of 0.01% or more of one or more of Ni and Mo is preferably contained. However, when a total of more than 0.5% of one or more of Ni and Mo is contained, an unquenched steel sheet is hardened and the cold formability thereof is impaired. Therefore, the content of one or more of Ni and Mo is set to 0.5% or less in total. In a case of forming parts that are difficult to press-form and require high formability, even more excellent formability is necessary. Therefore, in such a case, the content of one or more of Ni and Mo is preferably 0.3% or less.

One or more of Sb, Sn, Bi, Ge, Te, and Se: 0.002% to 0.03% in total

Sb, Sn, Bi, Ge, Te, and Se are elements important in suppressing nitrogen entering into the steel through the surface. When the total content of one or more of these elements is less than 0.002%, no sufficient effect is observed. Therefore, when one or more of these elements is contained, the total content thereof is set to 0.002% or more. However, when these elements are contained in a content of more than 0.03% in total, the effect of preventing nitrogen from entering is saturated. These elements tend to segregate at grain boundaries. When the content of these elements is more than 0.03% in total, the content is too high and grain boundary embrittlement may possibly be caused. Thus, the total content of one or more of Sb, Sn, Bi, Ge, Te, and Se is set to 0.03% or less. When one or more of Sb, Sn, Bi, Ge, Te, and Se are contained, the upper limit of the total content is preferably 0.005% and the lower limit of the total content is preferably 0.020%.

In accordance with aspects of the present invention, since the content of one or more of Sb, Sn, Bi, Ge, Te, and Se is set to 0.002% to 0.03% in total, entering of nitrogen through a surface layer of a steel sheet is suppressed and an increase in the concentration of nitrogen in the surface layer of the steel sheet is suppressed even in a case where the steel sheet is annealed in a nitrogen atmosphere. As a result, the difference between the content of nitrogen contained in the range from the surface of the steel sheet to a depth of 150 μm in a thickness direction of the steel sheet and the average content of nitrogen contained in the whole steel sheet can be set to 30 mass ppm or less. Since entering of nitrogen can be suppressed as described above, even in a case where the steel sheet is annealed in a nitrogen atmosphere, the contents of solute Cr and solute Mo in the annealed steel sheet can be ensured, and thus, even higher hardenability can be obtained.

The remainder other than the above components is basically Fe and inevitable impurities. As the inevitable impurities, O: 0.005% or less and Mg: 0.003% or less are acceptable. As components not impairing an effect according to aspects of the present invention, Ti: 0.005% or less, Nb: 0.005% or less, and Cu: 0.04% or less may be contained.

2) Microstructure

The high-carbon hot-rolled steel sheet according to aspects of the present invention contains ferrite and cementite. The area fraction of ferrite is preferably 90% or more in order to ensure high formability. The area fraction of cementite is preferably 10% or less in order to ensure high formability. Even if remnant microstructures such as pearlite are formed other than ferrite and cementite, the effect according to aspects of the present invention will not be impaired if the total area fraction of the remnant microstructures is about 5% or less. Therefore, the remnant microstructures of such amount may be contained.

Cementite density: 0.25 grains/$\mu m^2$ or less

The cementite size obtained in the high-carbon hot-rolled steel sheet according to aspects of the present invention is about 0.1 μm to 3.0 μm in longitudinal diameter and is not a size effective in precipitation-hardening of a steel sheet. In accordance with aspects of the present invention, ferrite grains are made coarser by reducing the cementite density, thereby achieving a reduction in strength. In accordance with aspects of the present invention, by containing ferrite and setting the cementite density to 0.25 grains/$\mu m^2$ or less, a hardness of 110 HV to 160 HV and a total elongation of 40% or more are obtained. Therefore, the cementite density is set to 0.25 grains/$\mu m^2$ or less. The cementite density is preferably 0.15 grains/$\mu m^2$ or less and more preferably 0.1 grains/$\mu m^2$ or less.

Average ferrite grain size of 5 μm to 15 μm (preferable condition)

When the average ferrite grain size is less than 5 μm, the strength before cold forming increases and the press formability deteriorates in some cases. Therefore, the average ferrite grain size is preferably 5 μm or more and more preferably 7 μm or more. However, when the average ferrite grain size is more than 15 μm, the strength of a steel sheet decreases significantly in some cases. In a portion of a steel sheet used without annealing, the steel sheet needs to have strength to a certain degree. Therefore, the average ferrite grain size is preferably 15 μm or less and more preferably 12 μm or less. The microstructure, the cementite density in a ferrite grain, and the average ferrite grain size can be measured by methods described in an example below.

3) Mechanical Characteristics: A Hardness of 110 HV to 160 HV and a Total Elongation of 40% or More In accordance with aspects of the present invention, automotive parts, such as gears, transmissions, and seat recliners, are formed by cold pressing and thus, excellent cold formability is necessary. Additionally, it is necessary to increase the hardness by quenching to impart wear resistance to the steel sheet. Therefore, the high-carbon hot-rolled steel sheet according to aspects of the present invention needs to have excellent cold formability and enhanced hardenability, to such an extent that the hardness of the steel sheet is reduced to 110 HV to 160 HV, and the total elongation (El) of the steel sheet is increased to 40% or more.

4) Manufacturing Conditions

The high-carbon hot-rolled steel sheet according to aspects of the present invention is manufactured by using a steel having the above composition as a base material and by performing the following steps: rough hot rolling the steel; finish rolling the steel at a finishing temperature not lower than the Ar3 transformation temperature; coiling the steel at a coiling temperature of 500° C. to 700° C.; heating the steel to an annealing temperature not lower than the Ac1 transformation temperature and not higher than 800° C., and holding for 1 hr (hour) or more; cooling the steel to a temperature lower than the Ar1 transformation temperature at an average cooling rate of 1° C./hr to 20° C./hr; and holding the steel in a temperature range lower than the Ar1 transformation temperature for 20 hr or more. Alternatively, the high-carbon hot-rolled steel sheet is manufactured by performing the following steps: rough hot rolling the steel; finish rolling the steel at a finishing temperature not lower than the Ar3 transformation temperature; coiling the steel at a coiling temperature of 500° C. to 700° C.; holding the steel in a temperature range from 680° C. to 720° C. for 1 hr to 35 hr; heating the steel to an annealing temperature not lower than the Ac1 transformation temperature and not higher than 800° C., and holding for 1 hr or more; and cooling the steel to a cooling stop temperature not higher than the Ar1 transformation temperature and not lower than (the Ar1 transformation temperature−110° C.) at an average cooling rate of 1° C./hr to 20° C./hr.

Reasons for limitations in the methods for manufacturing the high-carbon hot-rolled steel sheet according to aspects of the present invention are described below.

Finishing temperature: not lower than the Ar3 transformation temperature

When the finishing temperature is lower than the Ar3 transformation temperature, coarse ferrite grains are formed after hot rolling and after annealing, and as a result, the elongation decreases significantly. Therefore, the finishing temperature is set to be not lower than the Ar3 transformation temperature. The upper limit of the finishing temperature is not necessary to be particularly limited, but is preferably set to 1,000° C. or lower for the purpose of smoothly performing cooling after finish rolling.

Coiling temperature: 500° C. to 700° C.

A hot-rolled steel sheet after finish rolling is coiled into a coil shape. When the coiling temperature is too high, the strength of the hot-rolled steel sheet will be too low. In such a case, when the hot-rolled steel sheet is coiled into a coil shape, the hot-rolled steel sheet may be deformed by the weight of the coil itself, which is not desirable operationally. Thus, the upper limit of the coiling temperature is set to 700° C. On the other hand, when the coiling temperature is too low, the hot-rolled steel sheet will become too hard, which is not desirable. Thus, the lower limit of the coiling temperature is set to 500° C. The coiling temperature is preferably 550° C. or higher. The coiling temperature is measured using the surface temperature of the steel sheet.

Two-stage annealing in which heating to an annealing temperature not lower than the Ac1 transformation temperature and not higher than 800° C. is performed, followed by holding for 1 hr or more (first-stage annealing), and cooling to a temperature lower than the Ar1 transformation temperature is performed at an average cooling rate of 1° C./hr to 20° C./hr, followed by holding in a temperature range lower than the Art transformation temperature for 20 hr or more (second-stage annealing)

In accordance with aspects of the present invention, the hot-rolled steel sheet is heated to a temperature not lower than the Ac1 transformation temperature and not higher than 800° C. and is held for 1 hr or more, such that relatively fine carbides precipitated in the hot-rolled steel sheet are dissolved so as to form solid solution in γ phase. Then, the hot-rolled steel sheet is cooled to a temperature lower than the Ar1 transformation temperature at an average cooling rate of 1° C./hr to 20° C./hr and is held in a temperature range lower than the Ar1 transformation temperature for 20 hr or more. In this way, undissolved C in ferrite grains will be precipitated at portions as nuclei, the portions being where austenite had been formed and C concentration is high. The cementite density will be set to 0.25 grains/$\mu m^2$ or less, and the dispersion of a carbide (cementite) will be put in a controlled state. That is, in accordance with aspects of the present invention, by performing two-stage annealing under predetermined conditions, the dispersion morphology of the carbide is controlled, a steel sheet is softened, and the elongation of the steel sheet is increased. In a high-carbon steel sheet according to aspects of the present invention, controlling the dispersion morphology of the carbide after annealing is important in softening. In accordance with aspects of the present invention, the high-carbon hot-rolled steel sheet is heated to a temperature not lower than the Ac1 transformation temperature and is held (first-stage annealing), whereby fine carbides are dissolved and C is allowed to form a solid solution in γ (austenite). Thereafter, in a cooling stage to a temperature lower than the Ar1 transformation temperature and a holding stage (second-stage annealing), α/γ interfaces and undissolved carbides present in a temperature range not lower than the Ac1 temperature serve as nucleation sites to allow relatively coarse carbides to precipitate. Conditions for such two-stage annealing are described below. Incidentally, an atmosphere gas used for annealing may be any of nitrogen, hydrogen, and a gas mixture of nitrogen and hydrogen.

Heating to an annealing temperature not lower than the Ac1 transformation temperature and not higher than 800° C. and holding for 1 hr or more (first-stage annealing)

By heating the hot-rolled steel sheet to an annealing temperature not lower than the Ac1 temperature, a portion of ferrite in the microstructure of the steel sheet is transformed into austenite, fine carbides precipitated in ferrite are dissolved, and C is allowed to form a solid solution in austenite. On the other hand, ferrite (α) remaining without being transformed into austenite is annealed at a high temperature; hence, the dislocation density decreases and softening occurs in the ferrite. Relatively coarse carbides (undissolved carbides) that did not dissolve remain in ferrite and become coarser due to Ostwald growth. When the annealing temperature is lower than the Ac1 transformation temperature, no austenite transformation occurs and therefore no carbides are allowed to form a solid solution in austenite. In accordance with aspects of the present invention, hot-rolled steel sheet is heated to a temperature not lower than the Ac1 transformation and is held for 1 hour or more because when the holding time at the temperature not lower than the Ac1 transformation temperature is less than 1 hr, fine carbides cannot be sufficiently dissolved. When the annealing temperature is higher than 800° C., the γ fraction becomes too high. In such a case, in the course of subsequent cooling, spheroidization is not completed partially in an austenite region and rod-shaped cementite is formed, leading to a reduction in formability. Hence, the annealing temperature is set to 800° C. or lower. In first-stage annealing, the upper limit of the holding time is not particularly limited, but is preferably set to 20 hr or less. Incidentally, the above holding time includes the holding time at a certain temperature not lower than the Ac1 transformation temperature and not higher than 800° C. and the transit time of the steel sheet in a temperature range from the Ac1 transformation temperature to 800° C.

Average cooling rate down to below the Ar1 transformation temperature: cooling at 1° C./hr to 20° C./hr After the above first-stage annealing, the steel sheet is cooled to a temperature lower than the Ar1 transformation temperature, which is in the temperature range of second-stage annealing, at 1° C./hr to 20° C./hr. During cooling, C removed from austenite in the course of the austenite-to-ferrite transformation precipitates in the form of relatively coarse spherical carbides at α/γ interfaces or undissolved carbides serving as nucleation sites. In the cooling, the cooling rate needs to be adjusted such that pearlite is not formed. When the average cooling rate until the second-stage annealing after the first-stage annealing is less than 1° C./hr, production efficiency is low. Therefore, the average cooling rate is set to 1° C./hr or more. However, when the average cooling rate is greater than 20° C./hr, pearlite will precipitate and the hardness will become too high. Therefore, the average cooling rate is set to 20° C./hr or less. Thus, after the first-stage annealing, cooling to a temperature lower than the Ar1 transformation temperature, which is in the temperature range of the second-stage annealing, is performed at an average cooling rate of 1° C./hr to 20° C./hr.

Holding in a temperature range (annealing temperature) lower than the Ar1 transformation temperature for 20 hr or more (second-stage annealing)

After the above first-stage annealing, cooling is performed at a predetermined cooling rate, followed by holding at a temperature lower than the Ar1 transformation temperature, whereby coarse spherical carbides are further grown by Ostwald growth and fine carbides are eliminated. When the holding time at a temperature lower than the Ar1 transformation temperature is less than 20 hr, carbides cannot grow sufficiently and the post-annealing hardness will be too high. Therefore, in the second-stage annealing, holding is performed at a temperature lower than the Ar1 transformation temperature for 20 hr or more. The temperature of the second-stage annealing is not particularly limited, but is preferably set to 660° C. or higher for the purpose of sufficiently growing carbides. From the viewpoint of production efficiency, the upper limit of the holding time is preferably set to 30 hr or less. Incidentally, the above holding time includes the holding time at a certain temperature lower than the Ar1 transformation temperature and the transit time of the steel sheet in a temperature range lower than the Ar1 transformation temperature.

Alternatively, the high-carbon hot-rolled steel sheet can be manufactured in such a manner that, after coiling, holding is performed in a temperature range from 680° C. to 720° C. for 1 hr to 35 hr (first-stage annealing), heating to an annealing temperature not lower than the Ac1 transformation temperature and not higher than 800° C. is performed, followed by holding for 1 hr or more (second-stage annealing), and cooling to a cooling stop temperature not higher than the Ar1 transformation temperature and not lower than (the Ar1 transformation temperature−110° C.) is performed at an average cooling rate of 1° C./hr to 20° C./hr. Reasons for the above conditions are described below.

Holding in a temperature range (annealing temperature) from 680° C. to 720° C. for 1 hr to 35 hr (first-stage annealing)

In a case where the temperature is increased to a temperature not lower than the Ac1 transformation temperature, steel in which undissolved carbides remain in the γ region advantageously softens because, after the steel is held at a temperature lower than the Ar1 transformation temperature, the carbides become coarser at ferrite grain boundaries and the amount of the carbides in ferrite grains decreases. Because spheroidizing a microstructure before the temperature is increased to a temperature not lower than the Ac1 transformation temperature can enhance the above effect, it is necessary to hold at 680° C. to 720° C. for 1 hr to 35 hr. When the holding time is less than 1 hr, spheroidization does not proceed. Therefore, the holding time is set to 1 hr or more. The holding time is preferably 5 hr or more. However, when the holding time is more than 35 hr, the time is too long and production costs will increase. Therefore, the holding time is set to 35 hr or less. The holding time is preferably 25 hr or less.

Incidentally, the above holding time includes the holding time at a certain temperature in a temperature range from 680° C. to 720° C. and the transit time of the steel sheet in a temperature range from 680° C. to 720° C.

Heating to an annealing temperature not lower than the Ac1 transformation temperature and not higher than 800° C. and holding for 1 hr or more (second-stage annealing)

By heating the hot-rolled steel sheet to an annealing temperature not lower than the Ac1 temperature, a portion of ferrite in the microstructure of the steel sheet is transformed into austenite, fine carbides precipitated in ferrite are dissolved, and C is allowed to form a solid solution in austenite. On the other hand, ferrite remaining without being transformed into austenite is annealed at a high temperature; hence, the dislocation density decreases and softening occurs in the ferrite. Relatively coarse carbides (undissolved carbides) that did not dissolve remain in ferrite and become coarser due to Ostwald growth. When the annealing temperature is lower than the Ac1 transformation temperature, no austenite transformation occurs and therefore no carbides are allowed to form a solid solution in austenite. In accordance with aspects of the present invention, hot-rolled steel sheet is heated to a temperature not lower than the Ac1 transformation and is held for 1 hour or more because when the holding time at the temperature not lower than the Ac1 transformation temperature is less than 1 hr, fine carbides cannot be sufficiently dissolved. When the annealing temperature is higher than 800° C., the γ fraction becomes too high. In such a case, in the course of subsequent cooling, spheroidization is not completed in an austenite region partially and rod-shaped cementite is formed, leading to a reduction in formability. Hence, the annealing temperature is set to 800° C. or lower. In second-stage annealing, the upper limit of the holding time is not particularly limited, but is preferably set to 10 hr or less.

Incidentally, the above holding time includes the holding time at a certain temperature in a temperature range from the Ac1 transformation temperature to 800° C. and the transit time of the steel sheet in a temperature range from the Ac1 transformation temperature to 800° C.

Cooling stop temperature: cooling to a temperature not higher than the Ar1 transformation temperature and not lower than (the Ar1 transformation temperature−110° C.) at an average cooling rate of 1° C./hr to 20° C./hr After the above second-stage annealing, cooling is performed at 1° C./hr to 20° C./hr. During cooling, C removed from austenite in the course of the austenite-to-ferrite transformation precipitates in the form of relatively coarse spherical carbides at α/γ interfaces or undissolved carbides serving as nucleation sites. In the cooling, the cooling rate needs to be adjusted such that pearlite is not formed. When the average cooling rate is less than 1° C./hr, production efficiency is low. Therefore, the average cooling rate is set to 1° C./hr or more. However, when the average cooling rate is greater than 20° C./hr, pearlite will precipitate and the hardness will become too high. Therefore, the average cooling rate is set to 20° C./hr or less. Thus, after the second-stage annealing, cooling to a cooling stop temperature not higher than the Ar1 transformation temperature and not lower than (the Ar1 transformation temperature−110° C.) is performed at an average cooling rate of 1° C./hr to 20° C./hr.

When the cooling stop temperature is higher than the Ar1 transformation temperature, a ferrite transformation is not completed and pearlite partly precipitates. Therefore, the cooling stop temperature is set to be not higher than the Ar1 transformation temperature. However, when the cooling stop temperature is lower than (the Ar1 transformation temperature−110) ° C., the temperature is too low for carbides to grow. Therefore, the cooling stop temperature is set to be not lower than (the Ar1 transformation temperature−110° C.).

In order to produce high-carbon steel according to aspects of the present invention, both a converter and an electric furnace can be used. The high-carbon steel produced in such a manner is formed into a slab by ingot casting-blooming or continuous casting. The slab is usually heated and is then hot-rolled. In a case of manufacturing the slab by continuous casting, direct rolling process may be used in which the slab as cast is directly rolled or is heat-retained for the purpose of suppressing the reduction of temperature and is then rolled. In a case where the slab is heated and is then hot-rolled, the heating temperature of the slab is preferably set to 1,280° C. or lower for the purpose of avoiding the deterioration of the surface condition by scales. In hot rolling, in order to ensure the finishing temperature, material to be rolled may be heated with a heating means such as sheet bar heater during hot rolling.

Example 1

Steels, given Steel Numbers A to K, containing chemical components shown in Table 1 were produced; hot rolling was subsequently performed at a finishing temperature not lower than the Ar3 transformation temperature in accordance with manufacturing conditions shown in Tables 2 and 3, followed by pickling; and spheroidizing annealing was performed in a nitrogen atmosphere (atmosphere gas: nitrogen) by two-stage annealing, whereby hot-rolled annealed steel sheets (high-carbon hot-rolled steel sheets) with a thickness of 3.0 mm were manufactured. For the hot-rolled annealed steel sheets, which were manufactured as described above, microstructure, hardness, elongation, and quenching hardness were determined as described below.

Incidentally, the Ar1 transformation temperature, Ac1 transformation temperature, and Ar3 transformation temperature shown in Table 1 were determined as described below. A linear expansion curve during heating was measured with a Formaster testing machine using a cylindrical specimen (a diameter of 3 mm×a height of 10 mm), and the temperature at which the transformation from ferrite to austenite started (the Ac1 temperature) was determined. A linear expansion curve was measured in such a manner that a similar specimen was heated to the austenite single-phase region and was cooled from the austenite single-phase region to room temperature, and the temperature at which the transformation from austenite to ferrite started (the Ar3 temperature) and the temperature at which the transformation from austenite to ferrite ended (the Ar1 temperature) were determined.

Microstructure

For determination of the microstructure of each hot-rolled annealed steel sheet, a sample taken from a lateral central portion (a central portion in the width direction) of the steel sheet was cut, was polished, and was then etched with nital. The number of cementite grains with a longitudinal diameter of 0.1 μm or more was measured in each of microstructure photographs taken at five spots in the lateral central portion of the steel sheet at 3,000× magnification using a scanning electron microscope; and the cementite density was determined by dividing the measured numbers of cementite grains by the area of a field of view of photographs. From the microstructure photographs taken at the above spots, the average ferrite grain size was determined by an evaluation method (cutting method) for the apparent grain size according to JIS G 0551.

Hardness of annealed steel sheet (hot-rolled annealed steel sheet) (in tables, shown as hardness of blank sheet)

A sample was taken from a lateral central portion of each annealed steel sheet. Measurements were taken at five spots at a through-thickness one-fourth position of a cross-sectional microstructure parallel to the rolling direction using a Vickers hardness tester (0.3 kgf), and an average was determined.

Elongation of annealed steel sheet (hot-rolled annealed steel sheet) (in tables, shown as elongation of blank sheet)

A tensile test was performed with a tensile tester, AG10TB AG/XR, manufactured by Shimadzu Corporation at 10 mm per minute using a JIS No. 5 tensile specimen cut out of each annealed steel sheet in a direction (L direction) at 0° to the rolling direction and the elongation was determined by butting fractured samples.

Hardness of quenched steel sheet (in tables, shown as quenching hardness)

Flat specimens (a width of 15 mm×a length of 40 mm×a thickness of 3 mm) were taken from the lateral center of each annealed steel sheet (hot-rolled annealed steel sheet) and were quenched by two methods, that is, water quenching and oil quenching at 70° C. as described below, and the hardness (quenching hardness) of the steel sheet quenched by respective methods was determined. That is, quenching was performed by a method (water quenching) in which the flat specimens were held at 900° C. for 600 s and were immediately water-cooled and by a method (oil quenching at 70° C.) in which the flat specimens were held at 900° C. for 600 s and were immediately oil-cooled at 70° C. For hardening characteristics, five spots on a cut surface of each quenched specimen were measured for hardness under a load of 1 kgf using a Vickers hardness tester and the average hardness was determined and was defined as the quenching hardness. For the quenching hardness, cases where both the hardness after water quenching and the hardness after oil quenching at 70° C. satisfied conditions shown in Table 4 were judged pass (○) and were rated excellent in hardenability. Cases where either the hardness after water quenching or the hardness after oil quenching at 70° C. did not satisfy the conditions shown in Table 4 were judged fail (x) and were rated poor in hardenability. Incidentally, Table 4 shows the quenching hardness corresponding to the C content that is experientially rated sufficient in hardenability.

TABLE 1

| Steel number | Chemical component (mass percent) | | | | | | | | | | |
|---|---|---|---|---|---|---|---|---|---|---|---|
| | C | Si | Mn | P | S | sol. Al | N | Cr | Ni | Mo | Sb, Sn, Bi, Ge, Te, Se |
| A | 0.20 | 0.21 | 0.60 | 0.02 | 0.004 | 0.01 | 0.0044 | 0.97 | — | — | — |
| B | 0.20 | 0.22 | 0.75 | 0.01 | 0.003 | 0.01 | 0.0041 | 0.90 | — | — | Sb: 0.005 |
| C | 0.23 | 0.18 | 0.55 | 0.01 | 0.003 | 0.06 | 0.0050 | 1.20 | — | — | — |
| D | 0.20 | 0.21 | 0.89 | 0.02 | 0.004 | 0.03 | 0.0050 | 1.00 | — | — | Sb + Sn + Bi + Ge + Te + Se: 0.020 |
| E | 0.20 | 0.35 | 0.60 | 0.01 | 0.003 | 0.04 | 0.0045 | 1.20 | 0.25 | — | Sb: 0.002 |
| F | 0.30 | 0.30 | 0.80 | 0.02 | 0.004 | 0.03 | 0.0044 | 0.91 | — | — | — |
| G | 0.15 | 0.25 | 0.75 | 0.02 | 0.003 | 0.04 | 0.0033 | 1.05 | 0.20 | 0.12 | Sb + Sn: 0.002 |
| H | 0.20 | 0.22 | 0.75 | 0.01 | 0.003 | 0.01 | 0.0041 | 0.90 | — | — | Sb: 0.015 |
| I | 0.22 | 0.23 | 0.60 | 0.02 | 0.003 | 0.04 | 0.0033 | 0.50 | 0.20 | — | — |
| J | 0.08 | 0.25 | 0.50 | 0.02 | 0.003 | 0.04 | 0.0033 | 1.00 | 0.20 | — | — |
| K | 0.15 | 0.25 | 0.40 | 0.02 | 0.003 | 0.03 | 0.0045 | 0.90 | — | — | — |

| Steel number | Ac1 transformation temperature (° C.) | Ar1 transformation temperature (° C.) | Ar3 transformation temperature (° C.) | Remarks |
|---|---|---|---|---|
| A | 740 | 730 | 825 | Within scope of present invention |
| B | 738 | 728 | 824 | Within scope of present invention |
| C | 744 | 734 | 825 | Within scope of present invention |
| D | 737 | 727 | 823 | Within scope of present invention |
| E | 740 | 731 | 827 | Within scope of present invention |
| F | 740 | 730 | 810 | Within scope of present invention |
| G | 739 | 729 | 836 | Within scope of present invention |
| H | 739 | 730 | 824 | Within scope of present invention |
| I | 733 | 723 | 825 | Outside scope of present invention |
| J | 742 | 732 | 868 | Outside scope of present invention |
| K | 741 | 731 | 847 | Outside scope of present invention |

TABLE 2

| Sample number | Steel number | Hot rolling conditions | | Annealing conditions | | | Microstructure | Cementite density (grains/μm$^2$) |
|---|---|---|---|---|---|---|---|---|
| | | Finishing temperature (° C.) | Coiling temperature (° C.) | First-stage annealing (annealing temperature-holding time) | Average cooling rate from first stage to second stage (° C./hr) | Second-stage annealing (annealing temperature-holding time) | | |
| 1 | A | 880 | 600 | 770° C.-4 hr | 10 | 710° C.-25 hr | Ferrite + cementite | 0.10 |
| 2 | A | 880 | 600 | 790° C.-1 hr | 10 | 700° C.-25 hr | Ferrite + cementite | 0.07 |
| 3 | B | 880 | 610 | 770° C.-6 hr | 20 | 710° C.-25 hr | Ferrite + cementite | 0.09 |
| 4 | B | 870 | 570 | 750° C.-8 hr | 10 | 700° C.-25 hr | Ferrite + cementite | 0.23 |
| 5 | C | 890 | 650 | 760° C.-4 hr | 12 | 710° C.-29 hr | Ferrite + cementite | 0.15 |
| 6 | D | 900 | 630 | 800° C.-1 hr | 18 | 710° C.-25 hr | Ferrite + cementite | 0.07 |
| 7 | E | 890 | 600 | 770° C.-2 hr | 5 | 690° C.-25 hr | Ferrite + cementite | 0.10 |

TABLE 2-continued

| | | | | | | | | |
|---|---|---|---|---|---|---|---|---|
| 8 | F | 900 | 600 | 770° C.-4 hr | 8 | 700° C.-25 hr | Ferrite + cementite | 0.09 |
| 9 | G | 900 | 550 | 770° C.-4 hr | 10 | 710° C.-25 hr | Ferrite + cementite | 0.09 |
| 10 | H | 880 | 610 | 770° C.-4 hr | 10 | 710° C.-25 hr | Ferrite + cementite | 0.08 |
| 11 | H | 880 | 610 | 800° C.-10 hr | 10 | 710° C.-25 hr | Ferrite + cementite | 0.12 |
| 12 | I | 900 | 600 | 770° C.-4 hr | 10 | 710° C.-25 hr | Ferrite + cementite | 0.09 |
| 13 | B | 880 | 610 | 820° C.-1 hr | 10 | 710° C.-22 hr | Ferrite + cementite | 0.30 |
| 14 | J | 870. | 620 | 770° C.-8 hr | 10 | 710° C.-25 hr | Ferrite + cementite | 0.07 |
| 15 | K | 880 | 610 | 770° C.-8 hr | 10 | 710° C.-25 hr | Ferrite + cementite | 0.10 |

| Sample number | Average ferrite grain size (μm) | Hardness of blank sheet (HV) | Elongation of blank sheet (%) | Hardness (Hv) Water quenching | Hardness (Hv) Oil quenching at 70° C. | Hardenability | Remarks |
|---|---|---|---|---|---|---|---|
| 1 | 8.0 | 136 | 42 | 481 | 435 | ○ | Inventive example |
| 2 | 8.0 | 135 | 42 | 475 | 446 | ○ | Inventive example |
| 3 | 9.0 | 136 | 42 | 490 | 445 | ○ | Inventive example |
| 4 | 5.5 | 136 | 43 | 483 | 442 | ○ | Inventive example |
| 5 | 7.3 | 137 | 41 | 473 | 436 | ○ | Inventive example |
| 6 | 8.3 | 138 | 40 | 490 | 450 | ○ | Inventive example |
| 7 | 7.8 | 135 | 42 | 482 | 438 | ○ | Inventive example |
| 8 | 8.5 | 150 | 40 | 605 | 560 | ○ | Inventive example |
| 9 | 8.6 | 130 | 44 | 430 | 400 | ○ | Inventive example |
| 10 | 8.2 | 136 | 42 | 490 | 440 | ○ | Inventive example |
| 11 | 16.0 | 110 | 47 | 490 | 435 | ○ | Inventive example |
| 12 | 8.0 | 132 | 42 | 482 | 380 | x | Comparative example |
| 13 | 9.0 | 135 | 38 | 483 | 435 | ○ | Comparative example |
| 14 | 9.50 | 100 | 45 | 360 | 300 | x | Comparative example |
| 15 | 9.00 | 130 | 43 | 425 | 320 | x | Comparative example |

TABLE 3

| Sample number | Steel number | Hot rolling conditions: Finishing temperature (° C.) | Hot rolling conditions: Coiling temperature (° C.) | Annealing conditions: First-stage annealing (annealing temperature-holding time) | Annealing conditions: Second-stage annealing (annealing temperature-holding time) | Annealing conditions: Cooling after second-stage (average cooling rate-cooling stop temperature) | Microstructure | Cementite density (grains/μm$^2$) |
|---|---|---|---|---|---|---|---|---|
| 16 | A | 880 | 600 | 710° C.-30 hr | 770° C.-4 hr | 10° C./hr-660° C. | Ferrite + cementite | 0.100 |
| 17 | A | 890 | 610 | 720° C.-4 hr | 760° C.-4 hr | 5° C./hr-650° C. | Ferrite + cementite | 0.150 |
| 18 | B | 880 | 590 | 690° C.-15 hr | 790° C.-2 hr | 10° C./hr-670° C. | Ferrite + cementite | 0.120 |
| 19 | C | 890 | 650 | 710° C.-10 hr | 750° C.-8 hr | 10° C./hr-680° C. | Ferrite + cementite | 0.018 |
| 20 | D | 900 | 630 | 680° C.-25 hr | 770° C.-1 hr | 10° C./hr-660° C. | Ferrite + cementite | 0.030 |
| 21 | E | 890 | 600 | 715° C.-6 hr | 770° C.-3 hr | 20° C./hr-650° C. | Ferrite + cementite | 0.030 |
| 22 | F | 900 | 600 | 710° C.-10 hr | 780° C.-10 hr | 10° C./hr-660° C. | Ferrite + cementite | 0.100 |
| 23 | G | 900 | 550 | 710° C.-20 hr | 760° C.-6 hr | 10° C./hr-680° C. | Ferrite + cementite | 0.180 |
| 24 | G | 880 | 610 | 710° C.-20 hr | 760° C.-6 hr | 10° C./hr-680° C. | Ferrite + cementite | 0.120 |
| 25 | I | 900 | 600 | 710° C.-20 hr | 760° C.-6 hr | 10° C./hr-680° C. | Ferrite + cementite | 0.120 |
| 26 | B | 880 | 610 | 710° C.-20 hr | 820° C.-6 hr | 10° C./hr-680° C. | Ferrite + cementite | 0.280 |

| Sample number | Average ferrite grain size (μm) | Hardness of blank sheet (HV) | Elongation of blank sheet (%) | Hardness(Hv) Water quenching | Hardness(Hv) Oil quenching at 70° C. | Hardenability | Remarks |
|---|---|---|---|---|---|---|---|
| 16 | 7.0 | 132 | 43 | 480 | 436 | ○ | Inventive example |
| 17 | 8.0 | 133 | 43 | 477 | 446 | ○ | Inventive example |
| 18 | 7.5 | 130 | 44 | 495 | 455 | ○ | Inventive example |
| 19 | 8.2 | 133 | 43 | 492 | 452 | ○ | Inventive example |
| 20 | 7.0 | 132 | 43 | 490 | 451 | ○ | Inventive example |
| 21 | 7.5 | 132 | 43 | 488 | 444 | ○ | Inventive example |
| 22 | 10.0 | 140 | 42 | 604 | 562 | ○ | Inventive example |
| 23 | 8.0 | 128 | 44 | 426 | 400 | ○ | Inventive example |
| 24 | 9.0 | 130 | 43 | 485 | 438 | ○ | Inventive example |
| 25 | 8.0 | 132 | 42 | 479 | 381 | x | Comparative example |
| 26 | 12.0 | 135 | 38 | 483 | 435 | ○ | Comparative example |

TABLE 4

| C content (mass percent) | Hardness after water quenching (HV) | Hardness after oil quenching at 70° C. (HV) |
|---|---|---|
| 0.10 to less than 0.15 | ≥380 | ≥310 |
| 0.15 to less than 0.18 | ≥420 | ≥350 |
| 0.18 to less than 0.20 | ≥450 | ≥380 |
| 0.20 to 0.33 | ≥460 | ≥400 |

From the above results, it is clear that each of hot-rolled steel sheets of inventive examples has a microstructure containing ferrite and cementite, where the cementite density is 0.25 grains/$\mu m^2$ or less, has a hardness of 110 HV to 160 HV, has a total elongation of 40% or more, and is excellent in both cold formability and hardenability.

The invention claimed is:

1. A high-carbon hot-rolled steel sheet having a composition containing, on a mass basis, C: 0.10% to 0.33%,
Si: 0.15% to 0.35%,
Mn: 0.5% to 0.9%,
P: 0.03% or less,
S: 0.010% or less,
sol. Al: 0.10% or less,
N: 0.0065% or less,
Ni: 0.20% to 0.5%, and
Cr: 0.90% to 1.5%, the remainder being Fe and inevitable impurities, the high-carbon hot-rolled steel sheet having a microstructure containing ferrite and cementite, a density of the cementite being 0.25 grains/$\mu m^2$ or less, and the high-carbon hot-rolled steel sheet having a hardness of 110 HV to 160 HV and a total elongation of 40% or more.

2. The high-carbon hot-rolled steel sheet according to claim 1, wherein the composition further contains Mo with a maximum amount of 0.5% in total of Ni and Mo.

3. The high-carbon hot-rolled steel sheet according to claim 1, wherein the composition further contains 0.002% to 0.03% of one or more of Sb, Sn, Bi, Ge, Te, and Se in total on a mass basis.

4. The high-carbon hot-rolled steel sheet according to claim 1, wherein the average grain size of the ferrite is 5 μm to 15 μm.

5. The high-carbon hot-rolled steel sheet according to claim 2, wherein the composition further contains 0.002% to 0.03% of one or more of Sb, Sn, Bi, Ge, Te, and Se in total on a mass basis.

6. The high-carbon hot-rolled steel sheet according to claim 2, wherein the average grain size of the ferrite is 5 μm to 15 μm.

7. The high-carbon hot-rolled steel sheet according to claim 3, wherein the average grain size of the ferrite is 5 μm to 15 μm.

8. The high-carbon hot-rolled steel sheet according to claim 5, wherein the average grain size of the ferrite is 5 μm to 15 μm.

9. A method for manufacturing the high-carbon hot-rolled steel sheet according to claim 1, comprising:

rough hot rolling steel;
finish-rolling the steel at a finishing temperature not lower than the Ar3 transformation temperature;
coiling the steel at a coiling temperature of 500° C. to 700° C.;
heating the steel to an annealing temperature not lower than the Ac1 transformation temperature and not higher than 800° C., and holding for 1 hr or more;
cooling the steel to a temperature lower than the Ar1 transformation temperature at an average cooling rate of 1° C./hr to 20° C./hr; and
holding the steel in a temperature range lower than the Ar1 transformation temperature for 20 hr or more.

10. A method for manufacturing the high-carbon hot-rolled steel sheet according to claim 1, comprising:

rough hot rolling steel;
finish-rolling the steel at a finishing temperature not lower than the Ar3 transformation temperature;
coiling the steel at a coiling temperature of 500° C. to 700° C.;
holding the steel in a temperature range from 680° C. to 720° C. for 1 hr to 35 hr;
heating the steel to an annealing temperature not lower than the Ac1 transformation temperature and not higher than 800° C., and holding for 1 hr or more; and
cooling the steel to a cooling stop temperature not higher than the Ar1 transformation temperature and not lower than (the Ar1 transformation temperature−110° C.) at an average cooling rate of 1° C./hr to 20° C./hr.

11. A method for manufacturing the high-carbon hot-rolled steel sheet according to claim 2, comprising:

rough hot rolling steel;
finish-rolling the steel at a finishing temperature not lower than the Ar3 transformation temperature;
coiling the steel at a coiling temperature of 500° C. to 700° C.;
heating the steel to an annealing temperature not lower than the Ac1 transformation temperature and not higher than 800° C., and holding for 1 hr or more;
cooling the steel to a temperature lower than the Ar1 transformation temperature at an average cooling rate of 1° C./hr to 20° C./hr; and
holding the steel in a temperature range lower than the Ar1 transformation temperature for 20 hr or more.

12. A method for manufacturing the high-carbon hot-rolled steel sheet according to claim 3, comprising:

rough hot rolling steel;
finish-rolling the steel at a finishing temperature not lower than the Ar3 transformation temperature;
coiling the steel at a coiling temperature of 500° C. to 700° C.;
heating the steel to an annealing temperature not lower than the Ac1 transformation temperature and not higher than 800° C., and holding for 1 hr or more;
cooling the steel to a temperature lower than the Ar1 transformation temperature at an average cooling rate of 1° C./hr to 20° C./hr; and
holding the steel in a temperature range lower than the Ar1 transformation temperature for 20 hr or more.

13. A method for manufacturing the high-carbon hot-rolled steel sheet according to claim 4, comprising:

rough hot rolling steel;
finish-rolling the steel at a finishing temperature not lower than the Ar3 transformation temperature;
coiling the steel at a coiling temperature of 500° C. to 700° C.;

heating the steel to an annealing temperature not lower than the Ac1 transformation temperature and not higher than 800° C., and holding for 1 hr or more;

cooling the steel to a temperature lower than the Ar1 transformation temperature at an average cooling rate of 1° C./hr to 20° C./hr; and holding the steel in a temperature range lower than the Ar1 transformation temperature for 20 hr or more.

14. A method for manufacturing the high-carbon hot-rolled steel sheet according to claim 2, comprising:

rough hot rolling steel;

finish-rolling the steel at a finishing temperature not lower than the Ar3 transformation temperature;

coiling the steel at a coiling temperature of 500° C. to 700° C.;

holding the steel in a temperature range from 680° C. to 720° C. for 1 hr to 35 hr;

heating the steel to an annealing temperature not lower than the Ac1 transformation temperature and not higher than 800° C., and holding for 1 hr or more; and cooling the steel to a cooling stop temperature not higher than the Ar1 transformation temperature and not lower than (the Ar1 transformation temperature−110° C.) at an average cooling rate of 1° C./hr to 20° C./hr.

15. A method for manufacturing the high-carbon hot-rolled steel sheet according to claim 3, comprising:

rough hot rolling steel;

finish-rolling the steel at a finishing temperature not lower than the Ar3 transformation temperature;

coiling the steel at a coiling temperature of 500° C. to 700° C.;

holding the steel in a temperature range from 680° C. to 720° C. for 1 hr to 35 hr;

heating the steel to an annealing temperature not lower than the Ac1 transformation temperature and not higher than 800° C., and holding for 1 hr or more; and cooling the steel to a cooling stop temperature not higher than the Ar1 transformation temperature and not lower than (the Ar1 transformation temperature−110° C.) at an average cooling rate of 1° C./hr to 20° C./hr.

16. A method for manufacturing the high-carbon hot-rolled steel sheet according to claim 4, comprising:

rough hot rolling steel;

finish-rolling the steel at a finishing temperature not lower than the Ar3 transformation temperature;

coiling the steel at a coiling temperature of 500° C. to 700° C.;

holding the steel in a temperature range from 680° C. to 720° C. for 1 hr to 35 hr;

heating the steel to an annealing temperature not lower than the Ac1 transformation temperature and not higher than 800° C., and holding for 1 hr or more; and cooling the steel to a cooling stop temperature not higher than the Ar1 transformation temperature and not lower than (the Ar1 transformation temperature−110° C.) at an average cooling rate of 1° C./hr to 20° C./hr.

* * * * *